US005251837A

United States Patent [19]

Kammann et al.

[11] Patent Number: 5,251,837

[45] Date of Patent: Oct. 12, 1993

[54] DEVICE FOR WINDING WEBS OF MATERIAL ONTO WINDING SHAFTS

[75] Inventors: Rolf Kammann, Westerkappeln; Wolfgang Kamlage, Hasbergen; Christoph Bauer, Ibbenbüren, all of Fed. Rep. of Germany

[73] Assignee: Windmöller & Hölscher, Lengerich, Fed. Rep. of Germany

[21] Appl. No.: 942,889

[22] Filed: Sep. 10, 1992

[30] Foreign Application Priority Data

Oct. 24, 1991 [DE] Fed. Rep. of Germany ..... 4135163
Jan. 10, 1992 [DE] Fed. Rep. of Germany ..... 4200478

[51] Int. Cl.[5] ..... B65H 18/16
[52] U.S. Cl. ..... 242/65
[58] Field of Search ..... 242/65, 67.1 R, 67.2, 242/56 R, 56 A, 75.1, 75.2

[56] References Cited

U.S. PATENT DOCUMENTS 2,361,795 10/1944 Roesen ..... 242/56 R
3,202,374 8/1965 Phelps ..... 242/65
3,380,685 4/1968 Crist et al. ..... 242/65
3,494,566 2/1970 Pawelczyk ..... 242/65 X
5,186,408 2/1993 Planeta ..... 242/65

FOREIGN PATENT DOCUMENTS 2364089 6/1975 Fed. Rep. of Germany .
3212960 10/1983 Fed. Rep. of Germany .

*Primary Examiner*—John M. Jillions
*Attorney, Agent, or Firm*—Keck, Mahin & Cate

[57] ABSTRACT

A device for winding webs of material onto winding shafts comprises a movable bearing supporting a winding shaft during winding, through which the supply roll being formed can be moved towards a contact roller and which can be moved in a position away therefrom for the removal of the completely wound supply roll. A new winding shaft accelerated approximately up to the speed of the web and onto which the cut leading end of the web can be wound, is inserted in the movable bearings. To prevent damage to the web, the weight of the supply roll is supported on the contact roller. The movable bearing is formed by two pairs of holding means, each pair of which can be moved synchronously with the other pair but also independently thereof. The pairs are adapted to hold a supply roll jointly as well as individually to hold a completely wound supply roll or a winding shaft with the leading end of the web wound thereon.

8 Claims, 7 Drawing Sheets

DEVICE FOR WINDING WEBS OF MATERIAL ONTO WINDING SHAFTS

BACKGROUND OF THE INVENTION

1. Field of the Invention

This invention relates to a device for winding webs of material onto winding shafts, comprising a movable bearing supporting a winding shaft during winding, through which the supply roll being formed can be moved towards a contact roller and which can be moved in a position away therefrom for the removal of the completely wound supply roll, and a means for inserting into the movable bearing a new winding shaft which has been accelerated to approximately the speed of the web and onto which the leading end of the web, formed by a severance cut, is wound.

2. Description of the Prior Art

A combined contact and central winder is known from German Patent Publication DE-PS 32 12 960. The winder has a pair of receiving arms, pivotable about the axis of the contact roller, which receive a new winding shaft in a vertical position which, after its acceleration to the speed of the web, is lowered by a pair of frictional wheels onto a contact roller rotating at the same circumferential speed for winding the leading end of the web, severed by a severance cut, thereonto.

Then the receiving arms are pivoted by about 90 degrees so that the journals of the winding shaft can be inserted into the receptacles of a slide which moves away from the contact roller in accordance with the increasing diameter of the supply roll being formed. After effecting the severance cut, the slide is moved away from the contact roller to such an extent that the completed supply roll can be removed. Then the slide moves back in the direction towards the contact roller so that the receiving arms can insert the bearing journals of the winding shaft into the receptacles of the slide. In the known winding device, the winding shaft together with the supply roll being formed thereon are supported on the contact roller until the completely wound supply roll has been removed from the slide and the slide has again been moved back into its receiving position adjacent the contact roller. During this period of time, due to the high winding speed, a supply roll with such a large weight is formed that, because of the contact pressure, the web of material may be damaged. In particular when the web to be coiled is a thin film, damage to the film can be caused by the weight of the supply roll being formed so that the webs will become rejects. Furthermore, disturbances can occur in the web tension when it is switched from the frictional wheel drive being active until the newly coiled winding shaft is situated in the receptacles of the slide, to the central drive of the winding shaft (switching over of the drives when there are large winding diameters).

SUMMARY OF THE INVENTION

An object of the invention is to create a device of the type described in which winding of the newly wound roll can be carried out soon after the coiling under the defined winding conditions in order to ensure the prevention of damage to the web to be coiled during winding.

This problem is solved according to the invention by a device of this type in which a movable bearing is formed by two pairs of holding means, each pair of which can be moved synchronously with the other pair as well as independently of the other pair. The two pairs of holding means can, together, hold a supply roll, or each pair alone can hold either a wound supply roll or a winding shaft with the leading end of the web wound thereon. Thus, in a device according to the invention, the holding means include divisible receptacles or bearings for the journals of the winding shaft which jointly carry a supply roll being formed when moved next to each other, and which can be separated and moved apart from each other in such a manner that one pair releases the completely wound supply roll for removal while the other pair moves into the receiving position adjacent the contact roller. Then the pairs are once again moved towards each other such that the journals of the supply roll being formed are supported by the receptacles of both pairs.

Since one pair of the cooperating receptacles carries away the completely wound roll, while the other pair of receptacles is moved in its receiving position adjacent the contact roller for receiving the new winding shaft, the new winding shaft can be taken over by the receptacles when the new leading end of the web has been securely attached thereto by winding it thereon. The transfer of the new winding shaft, with the leading end of the web being wound thereon, to the receptacles of the one pair of holding means thus can already be carried out when only a few turns have been wound. At such time, the winding operation required for winding the material can also be stopped so that damage to a sensitive winding material is avoided. This is advantageous during the central winding as well as during the contact winding.

The receptacles can be arranged on slides which are slidable jointly or independently of each other. Advantageously, however, holding means are provided at the upper ends of pairs of levers mounted pivotally about a common axis and provided with separate pivot drives.

The holding means may include U-shaped receptacles, the legs thereof being constructed such that they are retractable and extendable and facing each other when the receptacles are moved apart. When the legs are extended, receptacles are formed in each holding means which can separately support the journals of the winding shafts. When the legs are retracted, the receptacles can be displaced with respect to one another such that the respective outer legs define the limits of a common receptacle.

In an advantageous embodiment, one of the receptacles of the two pairs of receptacles is provided with a driven shaft having a coupling half, which can be coupled to the other coupling half being provided at a journal of the winding shaft. In this way, the central drive of the supply roll can be effected.

In a further embodiment of the invention, swivel plates provided with a rotary drive are mounted on a flange above the journal of the contact roller, which include bearings for receiving a new winding shaft, and for the transfer thereof to receptacles of a pair of the holding means. Advantageously, the bearings are provided at a bar linkage which is guided on the swivel plate for the longitudinal displacement thereof. In order to enable the reception and the transfer of the winding shafts, the bar linkages are provided with a translatory drive. Advantageously, the bearings include shell-type receptacles in which the journals of the winding shaft are held by abutments fixedly secured to the swivel plates.

DETAILED DESCRIPTION OF PREFERRED EMBODIMENTS

An embodiment of the invention will now be described in more detail with reference to the drawings.

Figure 1:
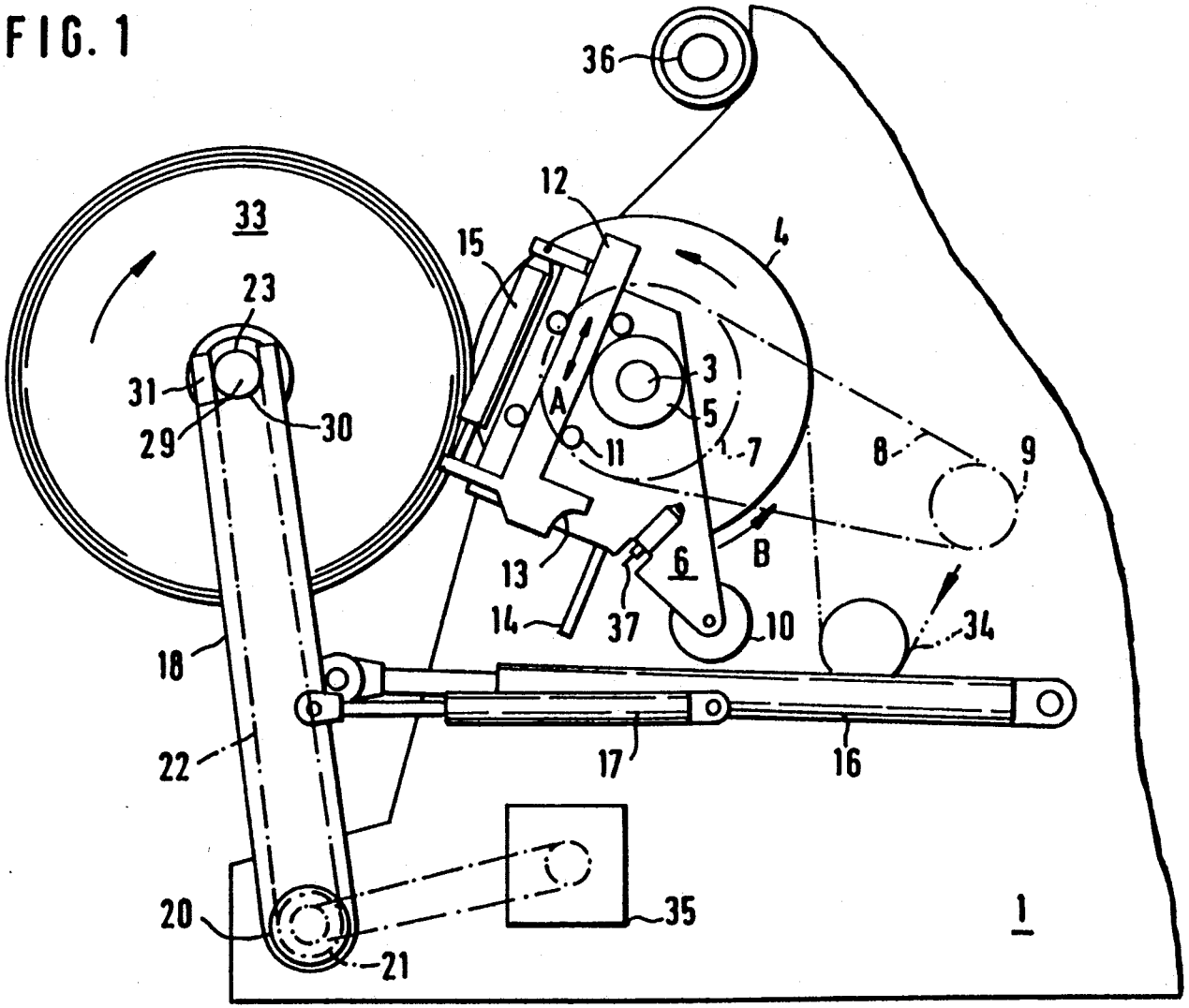
FIGS. 1 to 5 each show a schematic side elevational view of the winding device, in different successive operating positions.

In FIG. 1 there is shown a winding operation in which the roll exchange system is located in the initial position.

Figure 2:
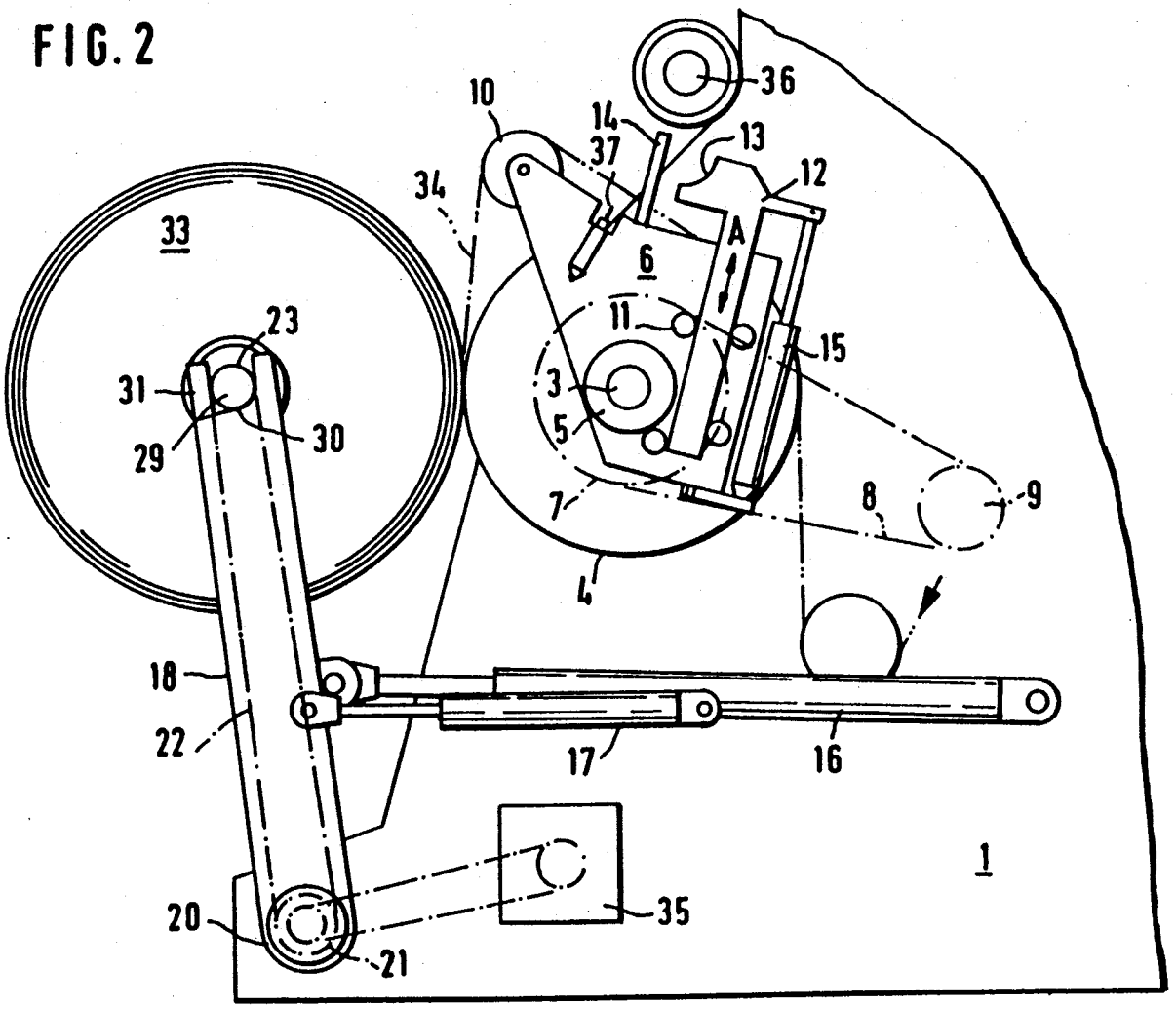

FIG. 2 shows the roll exchange system swung up below the prepared winding shaft 36.

Figure 3:
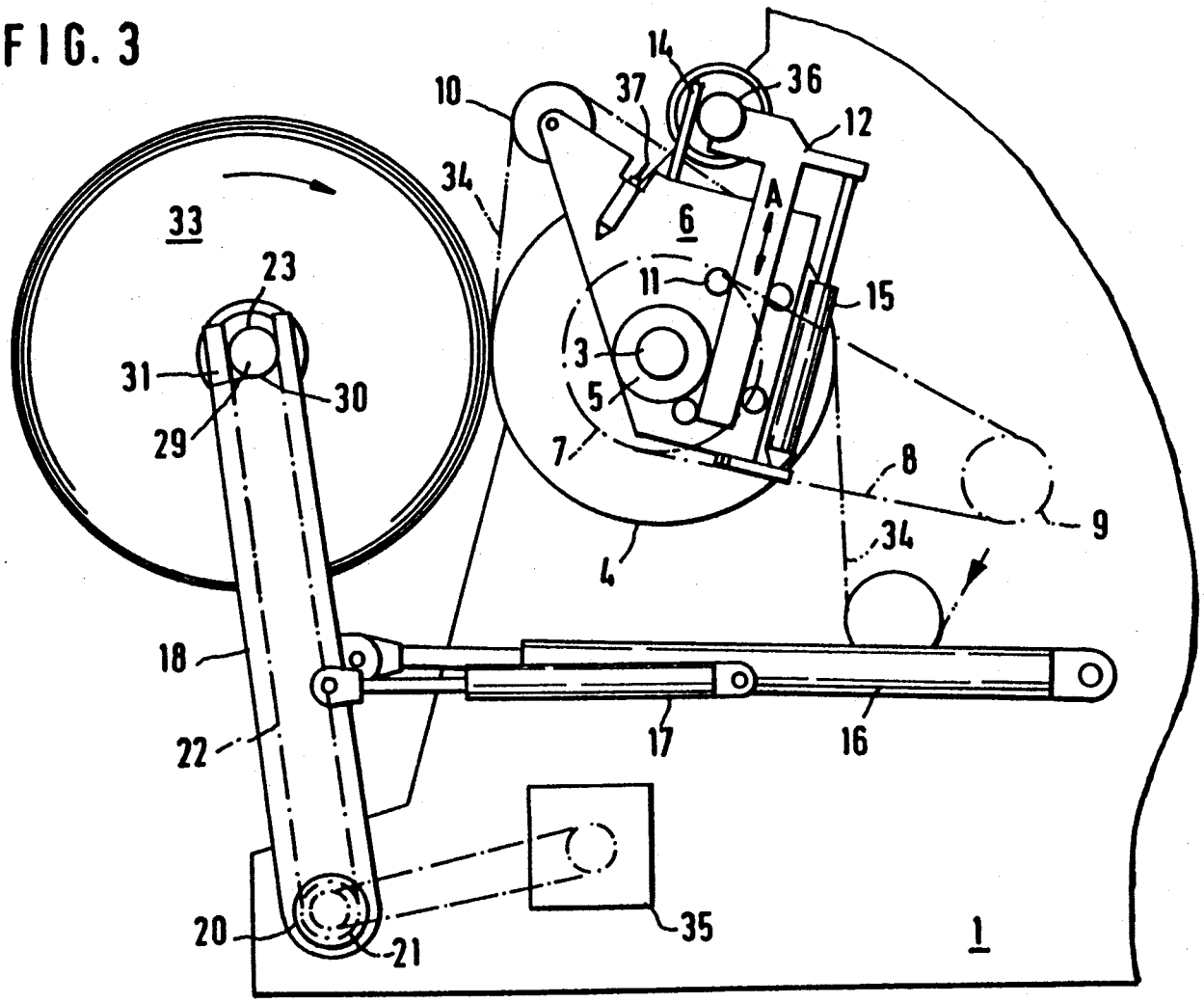

FIG. 3 shows the device in a state in which the new winding shaft is lowered and locked in the receptacles 13, the winding shaft not yet having any contact with the contact roller of the film web. The drive of the winding shaft is also speeded up to the speed of the web by means of the frictional wheel drive.

Figure 4:
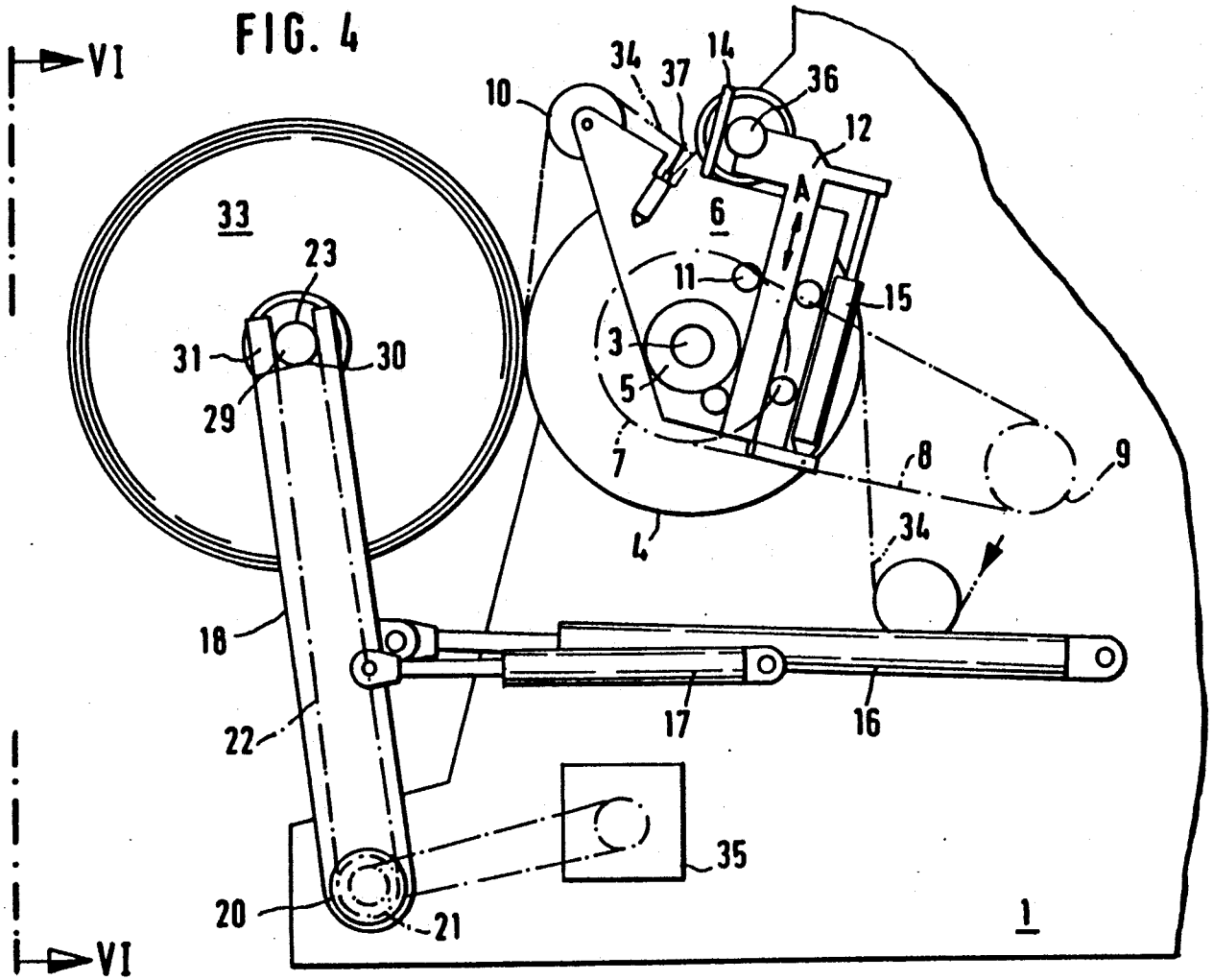

As shown in FIG. 4, the accelerated winding shaft is lowered onto the contract roller. Then the web is severed by means of the blade 37 and the leading end of the new web is glued onto the winding shaft.

Figure 5:
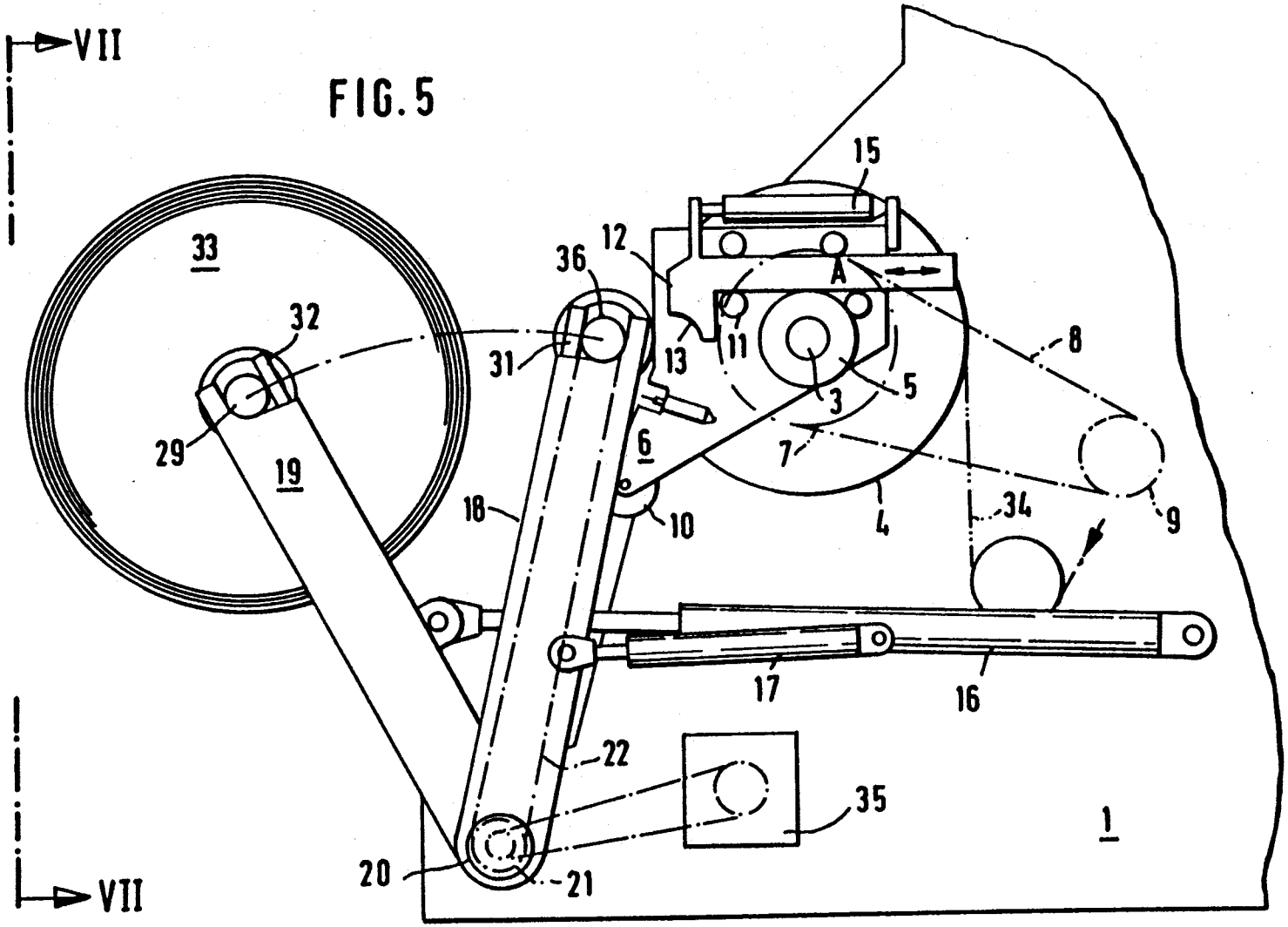

FIG. 5 shows the full roll being pivoted outwardly after the transfer of the roll from the outer arm pair to the inner arm pair. The empty outer arm pairs are pivoted towards the contact roller. The roll exchange system is pivoted with the new winding shaft for the transfer of the winding shaft to the outer arm pair. The roll exchange system is in its rest position.

The cooperation of the outer and the inner arm pairs, which rapidly permits winding in the defined winding method to be carried out, is explained in detail, as follows.

The machine frame of the winding device consists of two side frames 1 which are connected with each other by, for example, a crossbeam 2.

For the sake of clarity, the side frames facing the viewer are not shown in FIGS. 1 through 5. For instance, in FIG. 1 there can be seen a shaft 3 mounted in the two side frames 1, on which a contact roller 4 is fixedly placed. On both sides adjacent the contact roller 4 the shaft includes a bearing 5, respectively, which is freely rotatable on shaft 3. With each of the two bearings 5, a plate 6 as well as a disc 7 are fixedly connected. The discs 7 are connected with drive discs 9 via chains 8, a servomotor (not shown) being assigned to both drive discs 9.

The plates 6 are provided with protruding parts carrying a freely rotatable guide roller 10. Other freely rotatable guide rollers 11 are arranged on the plates 6 with respect to each other to form a guideway for each angled lever 12 associated with each plate 6. Each of the levers is provided with a receptacle 13 with which an abutment 14 is associated. The angled levers 12 can be moved to and fro in the direction of arrow A by means of a piston-cylinder unit 15 which provides a translatory drive for the bar linkage formed by angled levers 12.

Piston-cylinder units 16 and 17 are associated with each side frame 1, the piston cylinder units 17 acting upon outer pivoting arms 18 and the piston cylinder units 16 acting upon inner pivoting arms 19. Both sets of pivoting arms are mounted on a shaft 20 which is carried by the side frames 1.

Figure 6:
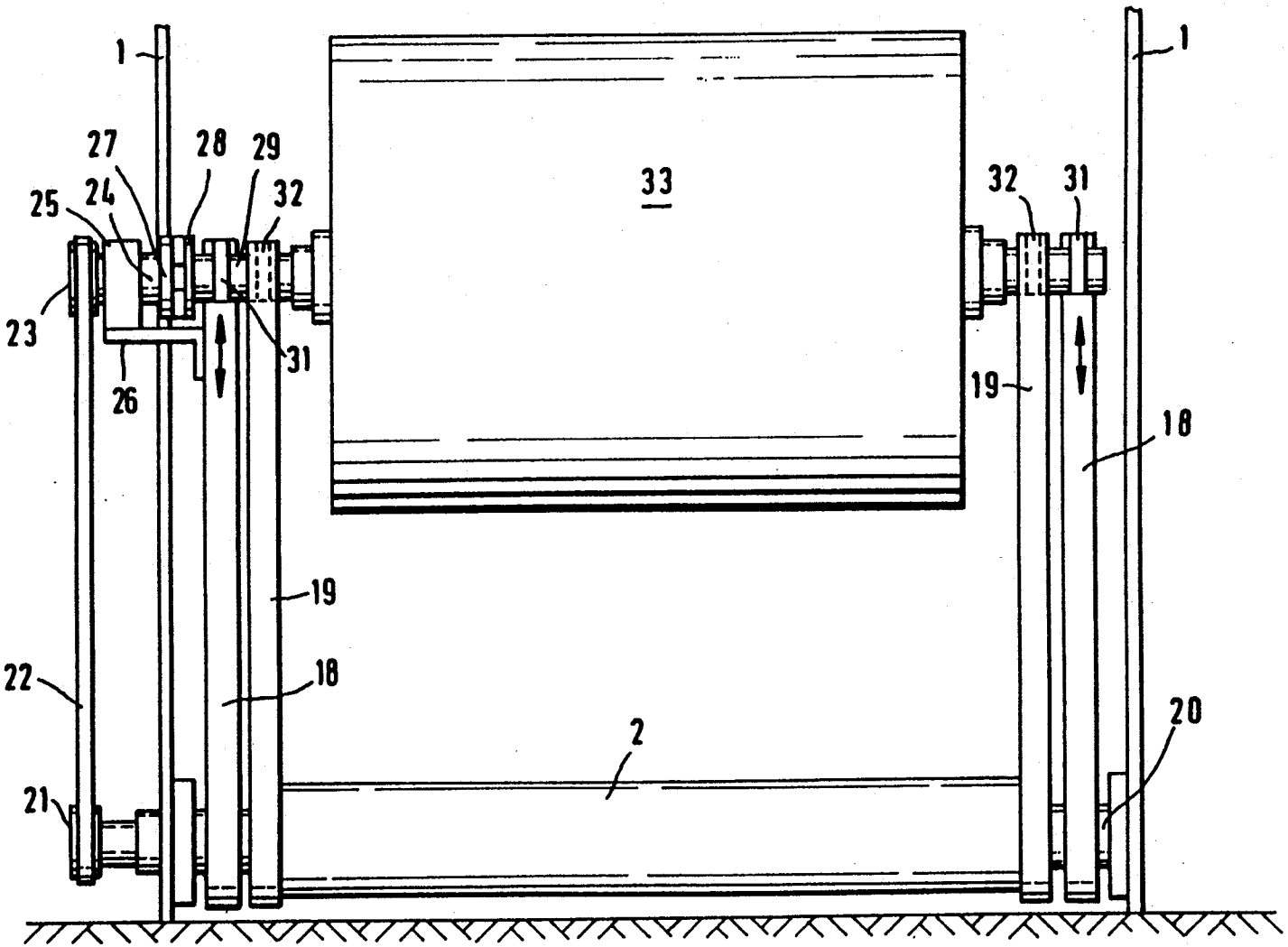
FIG. 6 shows a schematic elevational view of the winding device taken in the direction of the arrows VI—VI in FIG. 4.
Figure 7:
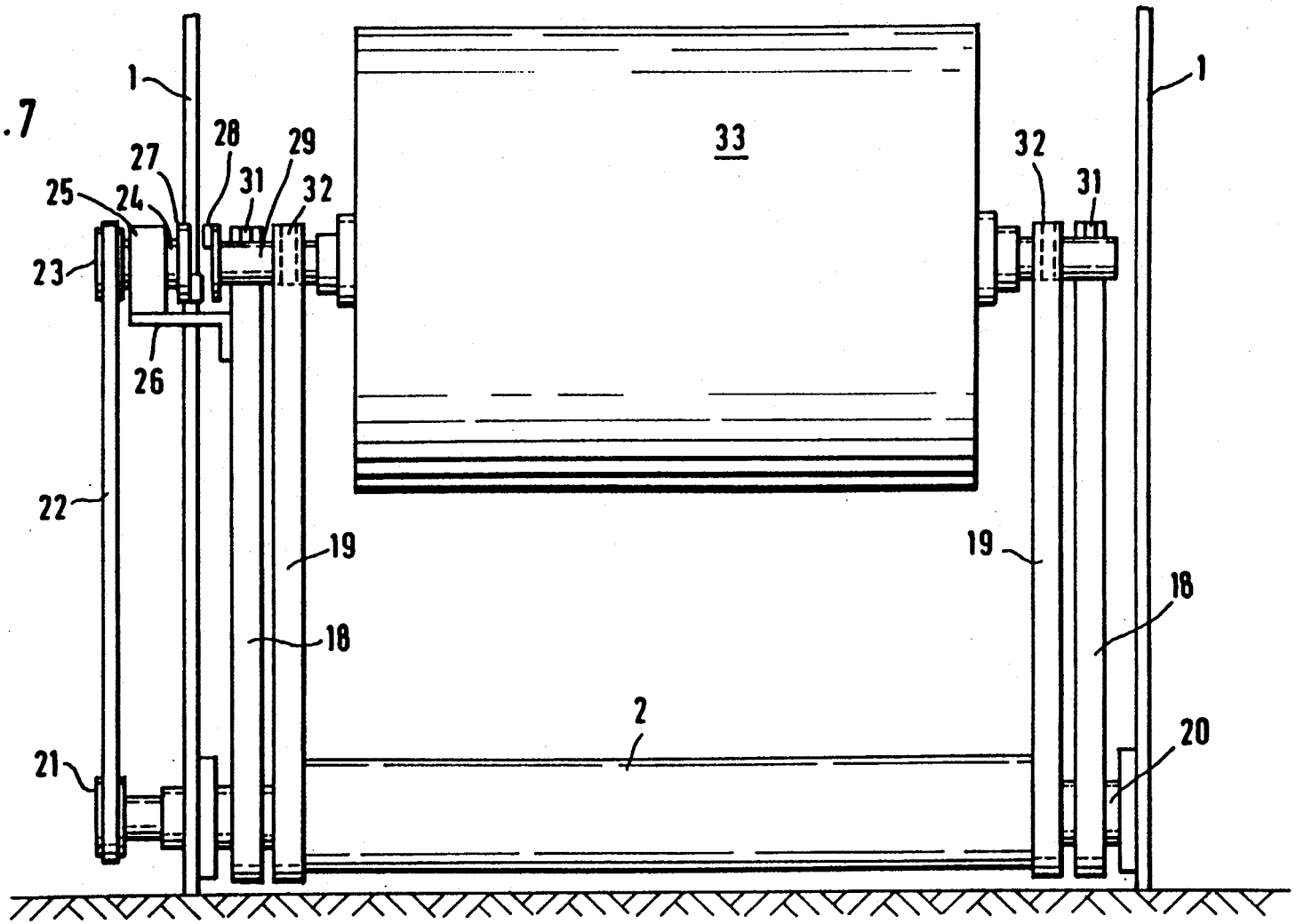
FIG. 7 shows a schematic elevational view of the winding device taken in the direction of the arrows VII—VII in FIG. 5.

As can be seen in FIGS. 6 and 7, the shaft 20 extends outwardly of the left side frame. A pulley 21 is fixed on the left end of the shaft 20. Pulley 21 is connected with another pulley 23 via the belt 22, the pulley 23 being mounted on a short shaft portion 24. Shaft portion 24 is mounted in a bearing block 25 which is connected to the left outer pivoting arm 18 by means of a holding element 26. At the end of the shaft portion 24, lying opposite the pulley 23, the shaft carries a coupling half 27 being connected with another coupling half 28 in the position shown in FIG. 6. Coupling half 28 is a part of each winding shaft 29. As is for instance indicated in FIGS. 1 and 6, the outer as well as the inner pivoting arms 18, 19 are provided with receptacles 30 with which displaceable locks 31 and 32 are associated.

The functioning of the winding device will now be described in detail, with respect to the structure which has been explained above in its basic principles.

FIG. 1 represents a situation in which a supply roll 33 laterally abuts the contact roller 4 and has a desired number of layers of web material 34 wound thereon. In this modification, the supply roll 33 is driven by a schematically indicated motor 35 via the pulley 21, the belt 22 and the pulley 23. The supply roll is mounted in the inner as well as in the outer pivoting arms 18 and 19. For the exchange of the rolls, the plate 6 is pivoted by means of the drive discs 9 in a counterclockwise direction (see direction of the arrow B) until the plate reaches the position represented in FIG. 2. In this case, the material web 34 is partially lifted off the contact roller 4 by the guide roller 10. In the position represented in FIG. 2, the receptacle 13 of the angled lever 12 is situated below a winding shaft 36 prepared with an adhesive strip, and the angled lever 12 is extended outward, in the direction shown by arrow A, by means of the piston cylinder unit 15 which provides a translatory drive for the bar linkage of angled lever 12.

In FIG. 3, the prepared winding shaft 36 is lowered into the receptacles 13. The winding shaft 36 is then mounted in the receptacles 13 and held therein by the abutments 14. It can be clearly seen that, in the position shown in FIG. 3, the winding shaft 36 does not yet have any contact to the web 34. At this time, the winding shaft 36 is accelerated by means of a frictional wheel drive (not shown) up to the speed of the contact roller 4 and then it is lowered onto the contact roller by means of the angled lever 12. The lowered position can be seen in FIG. 4. When the supply roll 33 has obtained its predetermined diameter, the web 34 is severed by the blade 37. Due to the adhesive strip on the new winding shaft 36, the leading end of web 34 sticks to the new winding shaft and is wound thereon. Directly thereupon, the completely would supply roll 33, which is held by the two receptacles 30 of the pivoting arms 18 and 19, is transferred to the inner pivoting arms 19. The lock 31 of the outer pair of pivoting arms, associated with the receptacle 30, is retracted and thus releases the roll. Then the inner pair of pivoting arms 19, which is driven by the piston cylinder unit 16, is moved outwardly, and simultaneously the outer pivoting arm pair 18, which is driven by the piston cylinder unit 17, is moved inwardly towards the contact roller 4. Also, simultaneously to the pivoting motions of the pairs of pivoting arms, the plate 6 is pivoted out of the position represented in FIG. 4 with the new winding shaft 36 into the position shown in FIG. 5, wherein during the pivoting motion the new winding shaft 36 is placed into the receptacles 30 of the two outer pivoting arms 18. The winding shaft 36 which, during its pivoting movement out of the position shown in FIG. 4, was driven by the contact roller 4, according to FIG. 5, can now be further coiled in the desired winding method.

What is claimed:

1. A device for winding a web of material onto a winding shaft, comprising:

a movable bearing supporting a winding shaft during winding, by which a supply roll being formed on said winding shaft can be moved towards a contact roller and which can be moved in a position away therefrom for the removal of the completely wound supply roll, and means for inserting into the movable bearing a new winding shaft which has been accelerated up to approximately the speed of the web and onto which the leading end of the web, formed by a severance cut, is wound, wherein the movable bearing comprises two pairs of holding means, each pair of which can be moved synchronously with the other pair as well as independently of the other pair, and wherein the pairs are adapted for holding a supply roll together and each pair alone is adapted for holding a wound supply roll or a winding shaft with the leading end of the web wound thereon, respectively.

2. A device according to claim 1 wherein the holding means is provided at the upper ends of pairs of levers mounted pivotally about a common axis and being provided with separate pivot drives.

3. A device according to claim 1, wherein the holding means comprises U-shaped receptacles, a leg of each said U-shaped receptacle thereof being retractable and extendable and said legs facing toward each other when the receptacles are moved apart from each other.

4. A device according to claim 3, wherein one of the receptacles of the two pairs of receptacles is provided with a driven shaft having a coupling half which can be coupled to the other coupling half provided at a journal of the winding shaft.

5. A device according to claim 1, wherein on a journal of the contact roller swivel plates are mounted, provided with a rotary drive, the swivel plates comprising receptacles for receiving a new winding shaft and for transfer thereof to the receptacles of the pair of holding means.

6. A device according to claim 5, wherein parts of the receptacles of the swivel plates are provided with a bar linkage which is guided on the swivel plates for the longitudinal displacement thereof.

7. A device according to claim 6, wherein the bar linkage is provided with a translator drive.

8. A device according to claim 7, wherein the swivel plates further comprise bearings having movable shell-type receptacles in which the journals of the winding shaft are held by abutments fixedly secured to the swivel plates.

* * * * *